US010161185B2

(12) United States Patent
Pascut

(10) Patent No.: US 10,161,185 B2
(45) Date of Patent: Dec. 25, 2018

(54) LADDER LEVELING AND STABILIZING ASSEMBLY

(71) Applicants: BIGFOOT LADDER SYSTEMS, LLC, Naples, FL (US); David Brian Pascut, Bloomfield Hills, MI (US)

(72) Inventor: David Brian Pascut, Bloomfield Hills, MI (US)

(73) Assignee: BIGFOOT LADDER SYSTEMS, LLC, Naples, FL (US)

( * ) Notice: Subject to any disclaimer, the term of this patent is extended or adjusted under 35 U.S.C. 154(b) by 95 days.

(21) Appl. No.: 15/113,687

(22) PCT Filed: Jan. 22, 2015

(86) PCT No.: PCT/US2015/012403

§ 371 (c)(1),
(2) Date: Jul. 22, 2016

(87) PCT Pub. No.: WO2015/112681

PCT Pub. Date: Jul. 30, 2015

(65) Prior Publication Data

US 2017/0009528 A1 Jan. 12, 2017

Related U.S. Application Data

(60) Provisional application No. 61/965,125, filed on Jan. 23, 2014, provisional application No. 61/965,126, filed on Jan. 23, 2014.

(51) Int. Cl.
*E06C 7/44* (2006.01)
*E06C 1/12* (2006.01)
(Continued)

(52) U.S. Cl.
CPC ..... *E06C 7/44* (2013.01); *E06C 1/12* (2013.01); *E06C 7/06* (2013.01); *E06C 7/423* (2013.01); *E06C 7/46* (2013.01)

(58) Field of Classification Search
CPC ..... E06C 7/00; E06C 7/42; E06C 7/44; E06C 7/426; B62J 2001/085
See application file for complete search history.

(56) References Cited

U.S. PATENT DOCUMENTS 199,922 A * 2/1878 Medart ..... E06C 1/16 182/171
607,664 A 7/1898 Seagrave
(Continued)

FOREIGN PATENT DOCUMENTS

DE 20012412 U1 1/2001
EP 1231356 A2 8/2002
(Continued)

OTHER PUBLICATIONS

Ladder Safety Accessories, Easi-Dec Access Systems Ltd. Merlin House, Blaydon Road, Sandy Bedfordshire SG18 1RZ, 2012.
(Continued)

*Primary Examiner* — Daniel P Cahn
(74) *Attorney, Agent, or Firm* — Dickinson Wright PLLC

(57) ABSTRACT

The assembly includes a first arcuate tube attached to a ladder. A second arcuate tube is slidably disposed in the first arcuate tube. A lock subassembly is disposed on the first arcuate tube for limiting movement of the second arcuate tube relative to the first arcuate tube. A step lever extends along the first arcuate tube and is coupled with the lock subassembly. A first flange and a second flange each extend radially from the first arcuate tube. An actuating member defines a cam surface abutting the second flange. A bar extends through the flanges and attaches to the actuating member. The step lever attaches to the actuating member to move the actuating member and cause the cam surface to slightly deform the first arcuate tube about the second
(Continued)

arcuate tube and engage the second arcuate tube. A foot is pivotably disposed at each end of the second arcuate tube.

9 Claims, 10 Drawing Sheets

(51) Int. Cl.
*E06C 7/06* (2006.01)
*E06C 7/42* (2006.01)
*E06C 7/46* (2006.01)

(56) References Cited

U.S. PATENT DOCUMENTS 973,509 A 10/1910 Ison
1,088,167 A 2/1914 Osterhoudt
1,088,168 A * 2/1914 Osterhoudt ..... E06C 7/44 182/200
1,241,392 A 9/1917 Johnson et al.
1,424,934 A 8/1922 Paterson et al.
1,928,158 A 9/1933 Ruse
2,320,144 A 5/1943 Johnson
2,548,311 A * 4/1951 Johnson ..... E06C 7/44 182/202
2,555,036 A 5/1951 Husted
2,598,875 A * 6/1952 Anderson ..... E06C 7/44 182/202
2,687,932 A * 8/1954 Hokanson ..... A47B 23/04 108/1
2,783,928 A 3/1957 Cox
2,854,180 A * 9/1958 Brunckhorst ..... E06C 7/44 182/202
2,960,182 A * 11/1960 Swanson ..... E06C 7/44 182/200
2,969,126 A * 1/1961 Gardner ..... E06C 7/44 182/202
2,971,602 A * 2/1961 West ..... E06C 7/44 182/200
3,032,140 A 5/1962 Hunt
3,037,580 A 6/1962 Fulkin
3,090,466 A * 5/1963 Wright ..... E06C 7/44 182/202
3,102,606 A * 9/1963 Hopfeld ..... E06C 7/44 182/202
3,165,170 A 1/1965 Blaney
3,199,628 A * 8/1965 Fagaly ..... E06C 7/44 182/200
3,199,629 A * 8/1965 Fagaly ..... E06C 7/44 182/200
3,484,814 A 12/1969 Meehan
3,880,388 A * 4/1975 Beguin ..... A47B 91/16 182/202
3,908,796 A 9/1975 Hurwitz
4,095,671 A * 6/1978 Forristall ..... E06C 7/44 182/202
4,243,122 A 1/1981 Coutts
4,456,095 A * 6/1984 Hodson ..... E06C 7/426 182/15
4,591,023 A * 5/1986 Hodson ..... E06C 7/44 182/107
4,607,726 A 8/1986 Davis et al.
4,852,689 A 8/1989 Erion
4,896,745 A 1/1990 Warnelov
4,984,655 A 1/1991 Scherer et al.
5,007,503 A * 4/1991 Sturm ..... E06C 7/44 182/202
5,094,320 A 3/1992 Deitz et al.
5,174,412 A 12/1992 Vega
5,507,364 A 4/1996 Spevak
5,522,473 A 6/1996 Moselsky
5,551,529 A 9/1996 Molitor
6,336,521 B1 * 1/2002 Dennis ..... E06C 7/44 182/200
6,557,878 B2 * 5/2003 Chen ..... B62J 1/08 280/226.1
6,644,216 B1 11/2003 Cole
8,162,273 B2 * 4/2012 Jones ..... B25H 1/18 182/107
8,627,927 B2 * 1/2014 Seibaek ..... A47B 91/16 182/202
9,883,744 B2 * 2/2018 Macyszyn ..... A47B 91/16
2005/0161287 A1 * 7/2005 Hosp ..... A47B 91/10 182/200
2008/0196973 A1 * 8/2008 Gomez Lopez ..... E06C 7/44 182/200
2009/0010776 A1 1/2009 Tsuchiya et al.
2011/0168492 A1 * 7/2011 Johnson ..... E06C 7/44 182/107
2011/0226551 A1 * 9/2011 Iverson ..... E06C 7/44 182/107

FOREIGN PATENT DOCUMENTS

FR 1012129 A 7/1952
FR 2621952 A1 4/1989
JP H0729299 U 6/1995
JP H0949382 A 2/1997
JP H1025982 A 1/1998

OTHER PUBLICATIONS

International Search Report, dated Jun. 25, 2015 (PCT/US2015/012403).
Thor-Stand Puts Ladders on Even Ground, Gizmag, http://www.gizmag.com/thor-stand-ladder-level/21959/pictures, accessed Jul. 3, 2014.

* cited by examiner

FIG. 3
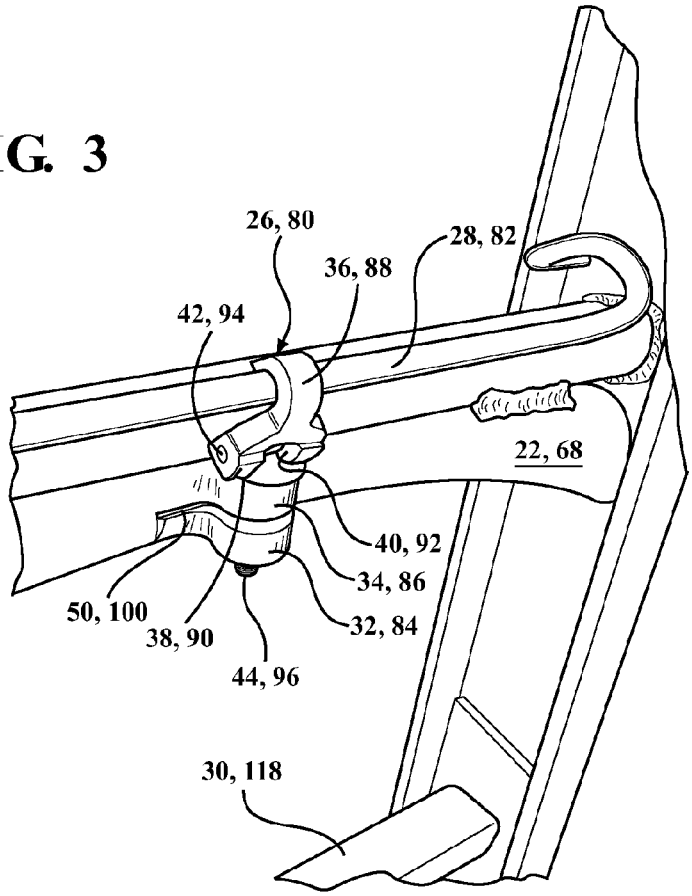
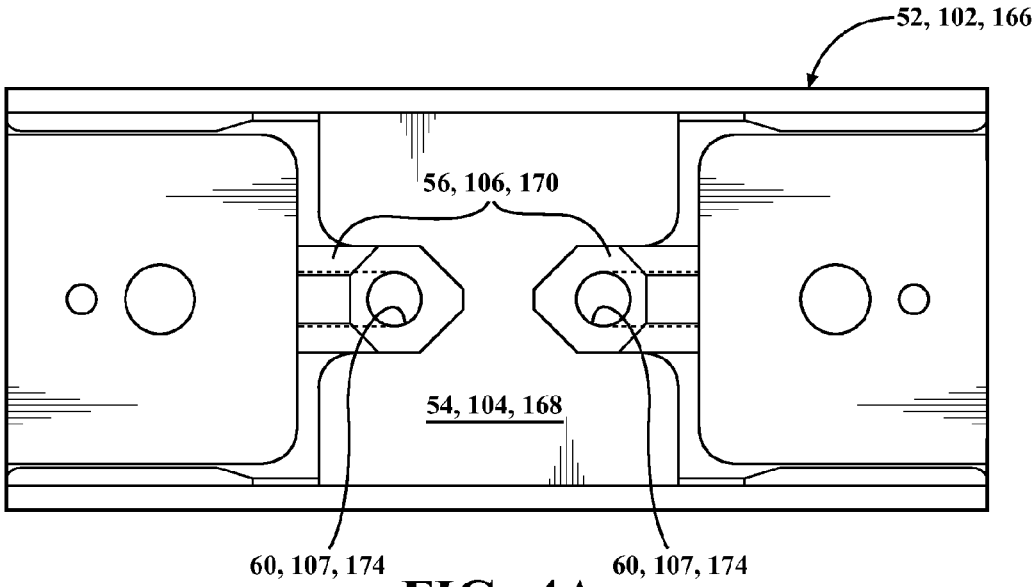
FIG. 4A

LADDER LEVELING AND STABILIZING ASSEMBLY

CROSS REFERENCE TO RELATED APPLICATION

This U.S. National Stage Patent Application claims the benefit of PCT International Patent Application Serial No. PCT/US2015/012403 filed Jan. 22, 2015 entitled "Ladder Leveling And Stabilizing Assembly," which claims the benefit of and priority to U.S. Provisional Patent Application Ser. No. 61/965,125 filed Jan. 23, 2014 and U.S. Provisional Patent Application Ser. No. 61/965,126 filed Jan. 23, 2014, the entire disclosures of each of which are incorporated herein by reference.

BACKGROUND OF THE INVENTION

1. Field of the Invention

An assembly for stabilizing and leveling a ladder. The subject invention is also related to a kit of parts for stabilizing and leveling a ladder.

2. Description of the Prior Art

It is common for a person using a ladder to require the use of the ladder on an uneven or sloped surface. However, many ladders in use today must be set up in area which is level or necessitate the use of blocks and shims in order to help level the ladder if it's used on a sloped, uneven, or rough surface. This can lead to dangerous workplace or working conditions at a home, as the ladder can shift suddenly if the blocks or shims move. Similarly, the user of the ladder may be forced to place the ladder on a level surface that is too far away from their work area. As a result, the user may then be required to extend themselves far away from the ladder to accomplish their tasks. Various approaches have been used to allow ladders to be set up on an uneven or sloped surface without requiring blocks and shims. One example of such a ladder leveling and stabilizing assembly is shown in U.S. Patent Application No. 2005/0161287 by Hosp, published Jul. 28, 2005 ("Hosp"). Hosp discloses a ladder leveling and stabilizing assembly including a first arcuate tube for attachment to the ladder. A second arcuate tube is slidably disposed in the first arcuate tube. A lock subassembly is disposed on the first arcuate tube for engaging the second arcuate tube and limiting movement of the second arcuate tube relative to the first arcuate tube. There remains a need for an assembly which allows more convenient locking of the position of the second arcuate tube relative to the first arcuate tube while still enabling safe use of the ladder on uneven, sloped, or rough surfaces.

Additionally, ladders in use at a workplace may be required to meet various industry (e.g. American National Standards Institute) and workplace safety requirements which require that the lowest step of a ladder be disposed a minimum and a maximum height from the surface on which the ladder is being used. Therefore, it would also be advantageous for a ladder leveling and stabilizing assembly to meet these industry and safety requirements.

SUMMARY OF THE INVENTION

The invention provides for such a ladder leveling and stabilizing assembly that includes a lower step member disposed below the tubes and coupled with the first arcuate tube. A step lever extends along the first arcuate tube and is coupled with the lock subassembly. The step lever is movable between an unlocked position and locked position for moving the lock subassembly and limiting the movement of the second arcuate tube relative to the first arcuate tube in response to movement of the step lever to the locked position.

Thus several advantages of one or more aspects of the invention are that a user of the ladder leveling and stabilizing assembly may be able to conveniently lock the second arcuate tube relative to the first arcuate tube by beginning to climb the ladder and stepping on the step lever to move the lock subassembly which safely secures the second arcuate tube relative to the first arcuate tube. This provides a self-adjusting solution which does not require the user to use his or her hands to move the lock subassembly. Because the assembly also includes a lower step member, it is also capable of meeting various industry and safety requirements.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 3 is a perspective view of an embodiment of the ladder leveling and stabilizing assembly illustrating a lock subassembly;

FIG. 4A is a perspective view of a foot of the of the ladder leveling and stabilizing assembly illustrating a plate;

DESCRIPTION OF THE ENABLING EMBODIMENT

Referring to the Figures, wherein like numerals indicate corresponding parts throughout the several views, an assembly 20 for leveling and stabilizing a ladder constructed in accordance with the subject invention is shown in FIGS. 1-10.

Figure 1:
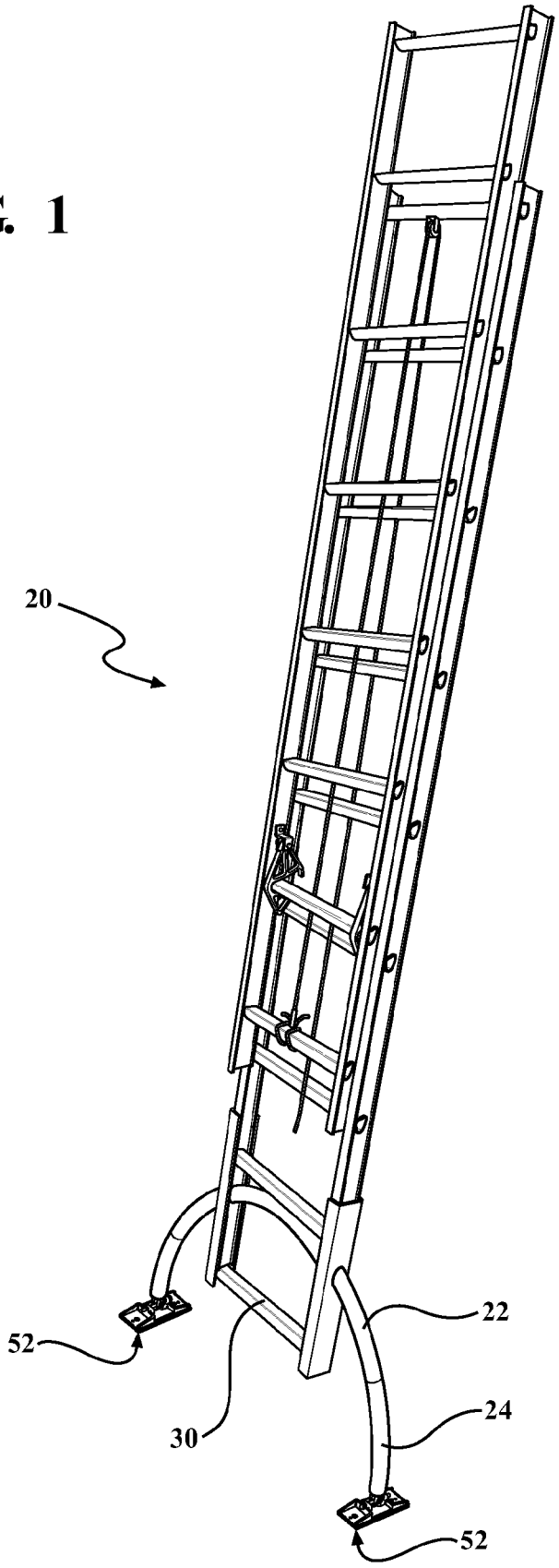
FIG. 1 is a perspective view of a preferred embodiment of a ladder leveling and stabilizing assembly.

In FIG. 1, the assembly 20, generally shown, includes a first arcuate tube 22 having a first length for attachment to the ladder. A second arcuate tube 24 has a second length that is greater than the first length and is slidably disposed in the first arcuate tube 22. In a preferred embodiment of the subject invention, the assembly is built into a ladder and the first arcuate tube 22 extends through and is attached to legs of the ladder. The lengths of the first arcuate tube 22 and the second arcuate tube 24 cause the tubes 22, 24 to extend out beyond the width of the ladder, which helps provide stability. A lock subassembly 26 (FIG. 2), generally indicated, is disposed on the first arcuate tube 22 for engaging the second arcuate tube 24 and for limiting movement of the second arcuate tube 24 relative to the first arcuate tube 22. Although, friction between the first arcuate tube 22 and the second arcuate tube 24 essentially acts an initial locking mechanism, it is generally desirable to include at least one additional locking mechanism such as the lock subassembly 26 to help immobilize the second arcuate tube relative to the first arcuate tube. As best shown in FIG. 3, a step lever 28 extends along the first arcuate tube 22 and is coupled with the lock subassembly 26. The step lever 28 is movable between an unlocked position and a locked position for moving the lock subassembly 26 and limiting the movement of the second arcuate tube 24 relative to the first arcuate tube 22 in response to movement of the step lever 28 to the locked position. Since the step lever 28 extends along and above the first arcuate tube 22 of the assembly 20, the user may easily move the step lever 28 as he or she begins to climb the ladder and steps on the second rung. By doing so, the lock subassembly 26 safely secures the second arcuate tube 24 relative to the first arcuate tube 22. This provides a solution which does not require the user to use his or her hands to move the lock subassembly 26. Also, because the second arcuate tube 24 is slidably disposed in the first arcuate tube 22, the assembly 20 may be considered self-adjusting since the second arcuate tube 24 easily slides within the first arcuate tube 22 as the assembly 20 is moved to an uneven, sloped, or rough surface.

Referring back to FIG. 1, the preferred embodiment of the assembly 20 includes a lower step member 30 which takes the form of a rung of the ladder that is disposed below the tubes 22, 24 of the assembly 20. This allows the assembly 20 to meet various industry (e.g. American National Standards Institute) and workplace safety requirements which require that the lowest step of a ladder be disposed a minimum and a maximum height from the surface on which the ladder is being used. However, it should be understood that some embodiments of the assembly 20 may utilize different structures for the lower step member 30.

As shown in FIG. 3, the first arcuate tube 22 of the assembly 20 includes a first flange 32 and a second flange 34 each extending radially from the first arcuate tube 22 in a spaced relationship and generally parallel to each other. The first flange 32 and the second flange 34 each define a passage. The lock subassembly 26 includes an actuating member 36 having a proximate end and a distal end. The actuating member 36 is movable between a clamped position and an unclamped position. The actuating member 36 defines a cam surface 38 disposed at the proximate end and a cavity 40 disposed at the distal end. The cam surface 38 of the actuating member 36 abuts the second flange 34. The actuating member 36 also includes a dowel 42 extending through the actuating member 36 adjacent the distal end. The lock subassembly 26 includes a bar 44 having a threaded portion and extends through the passage of the first flange 32 and through the passage of the second flange 34 into the cavity 40 of the actuating member 36. The dowel 42 of the actuating member 36 attaches to the bar 44 for allowing the actuating member 36 to rotate between the lock position and the unlock position. A nut (not shown) threadedly engages the threaded portion of the bar 44 and abuts the first flange 32. Although the lock subassembly 26 of the preferred embodiment uses the actuating member 36 with the cam surface 38 to move the flanges 32, 34 together, it should be understood that other lock subassemblies 26 may include alternative mechanisms such as, but not limited to a slide clamp, a rotary clamp, or a frictional interference lock.

The step lever 28 is attached to the actuating member 36 to move the actuating member 36 to the clamped position. The first arcuate tube 22 defines a channel 50 between the first flange 32 and the second flange 34 and adjacent to the actuating member 36. Movement of the step lever 28 to the locked position causes the cam surface 38 to move the second flange 34 toward the first flange 32 to slightly deform the first arcuate tube 22 about the second arcuate tube 24. This slight deformation of the first arcuate tube 22 causes the first arcuate tube 22 to engage the second arcuate tube 24. In contrast, movement of the step lever 28 to the unlocked position causes the cam surface 38 to move and allow the second flange 34 to move away from the first flange 32 and remove the deformation of the first arcuate tube 22 about the second arcuate tube 24. This allows the first arcuate tube 22 to disengage the second arcuate tube 24. Although the preferred embodiment of the invention utilizes the channel 50 to allow deformation of the first arcuate tube 22 about the second tube in response to the movement of the actuating member 36 to the clamped position, it should be understood that other embodiments may employ other approaches such as, but not limited to grooves or slots in various arrangements to allow the first arcuate tube 22 to be deformed.

Figure 2:
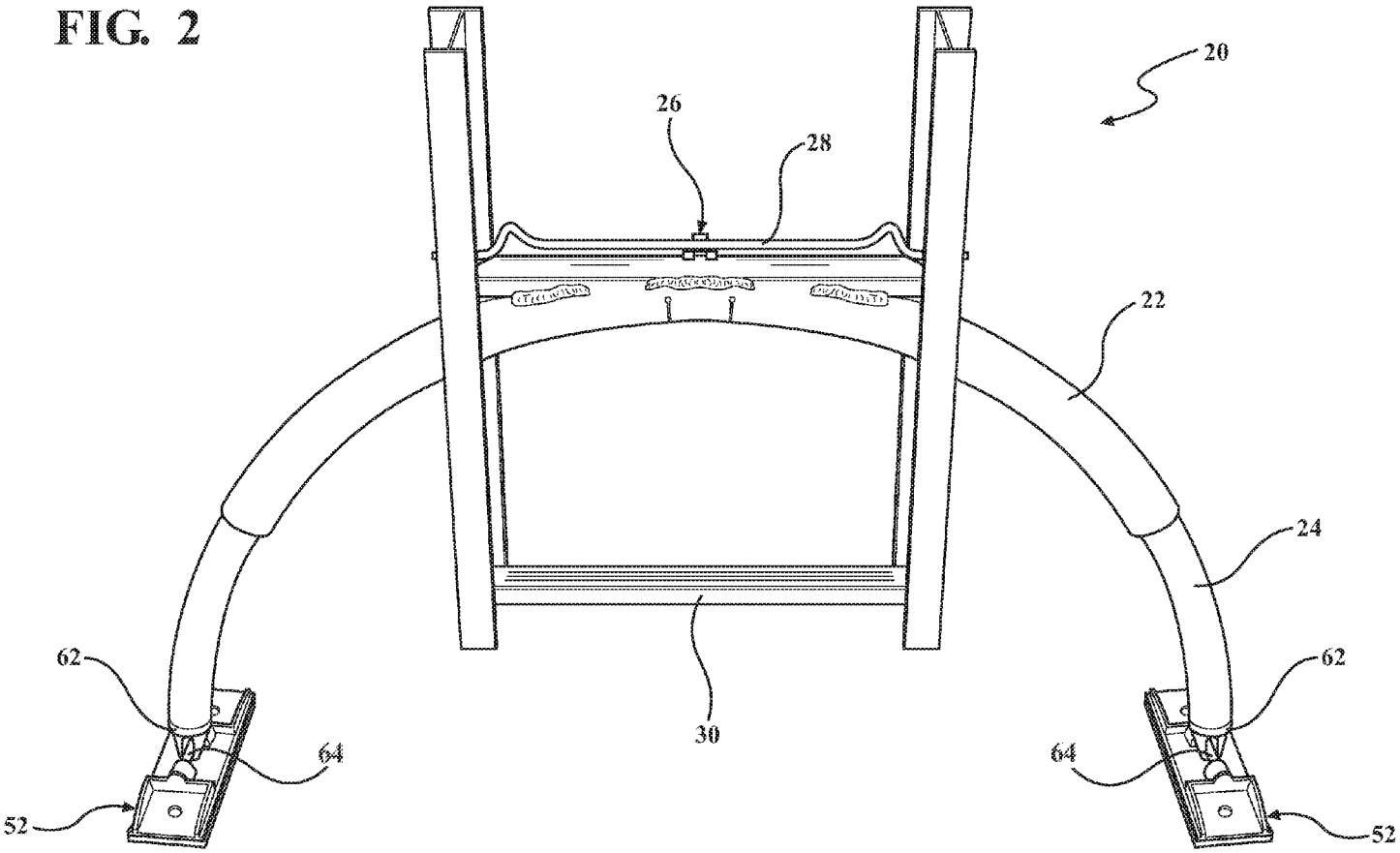
FIG. 2 is a perspective view of the preferred embodiment of the ladder leveling and stabilizing assembly.
Figure 4B:
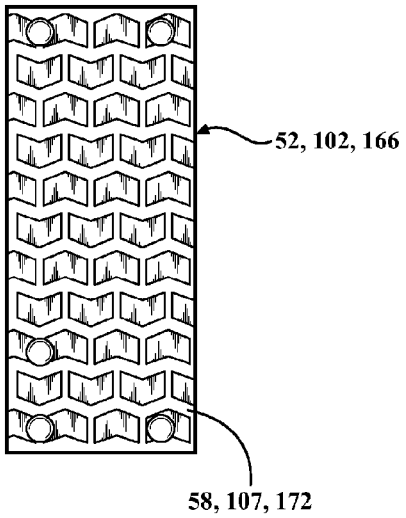
FIG. 4B is a perspective view of a foot of the of the ladder leveling and stabilizing assembly illustrating a cleated bottom.
Figure 4C:
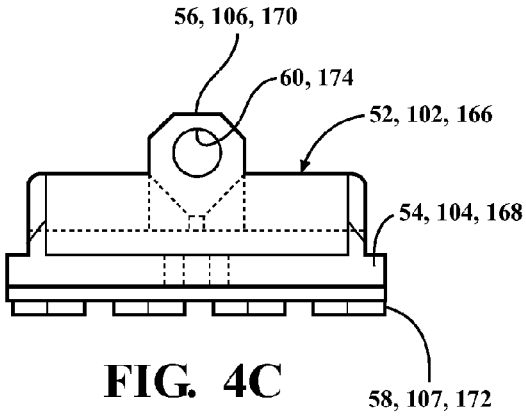
FIG. 4C is a perspective view of a foot of the of the ladder leveling and stabilizing assembly illustrating the cleated bottom attached to the plate.
Figure 4D:
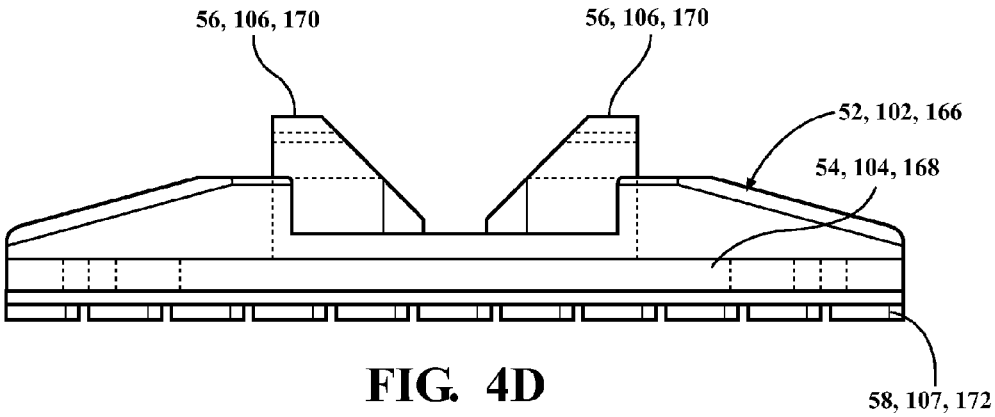
FIG. 4D is a perspective view of a foot of the of the ladder leveling and stabilizing assembly illustrating the cleated bottom attached to the plate.
Figure 5A:
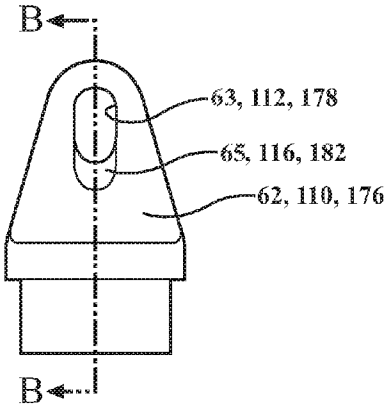
FIG. 5A is a perspective view of a connector illustrating an aperture.
Figure 5B:
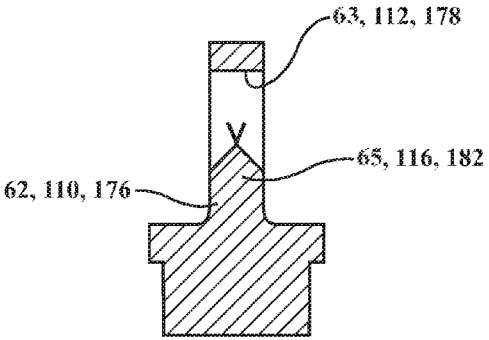
FIG. 5B is a cross-sectional view of the connector taken along line B-B illustrating a projection.

As best shown in FIGS. 1 and 2, a foot 52, generally indicated, is pivotably disposed at each end of the second arcuate tube 24 to allow the ladder to be placed on sloped, uneven, or rough surfaces. Referring now to FIGS. 4A-4D, the foot 52 includes a plate 54 and a pair of protrusions 56 extending from the plate 54. A cleated bottom 58 (FIG. 4B) is attached to the plate 54 for gripping a surface on which the ladder is placed. Each protrusion 56 defines an opening 60. The foot 52 also includes a connector 62 (FIGS. 5A and 5B) that defines an aperture 63 and is attached to the second arcuate tube 24. The connector 62 is disposed between the protrusions 56 of the foot 52. A bolt 64 extends through the openings 60 and between the protrusions 56 and through the aperture 63 of the connector 62 to pivotably attach the foot 52 to the second arcuate tube 24 and enable the foot 52 to pivot freely in three dimensions. As best shown in FIG. 5B, the connector 62 includes a projection 65 extending into the aperture 63 to allow a broad range of motion of the connector 62 relative to the bolt 64 as the foot 52 pivots. Because the projection 65 has a pointed, triangle shaped cross-section, the bolt 64 is able to move a greater amount relative to the connector 62 than what would be possible if the aperture 63 did not include a projection 65. Therefore the foot 52 is able to have a broad range of motion as well.

Figure 6:
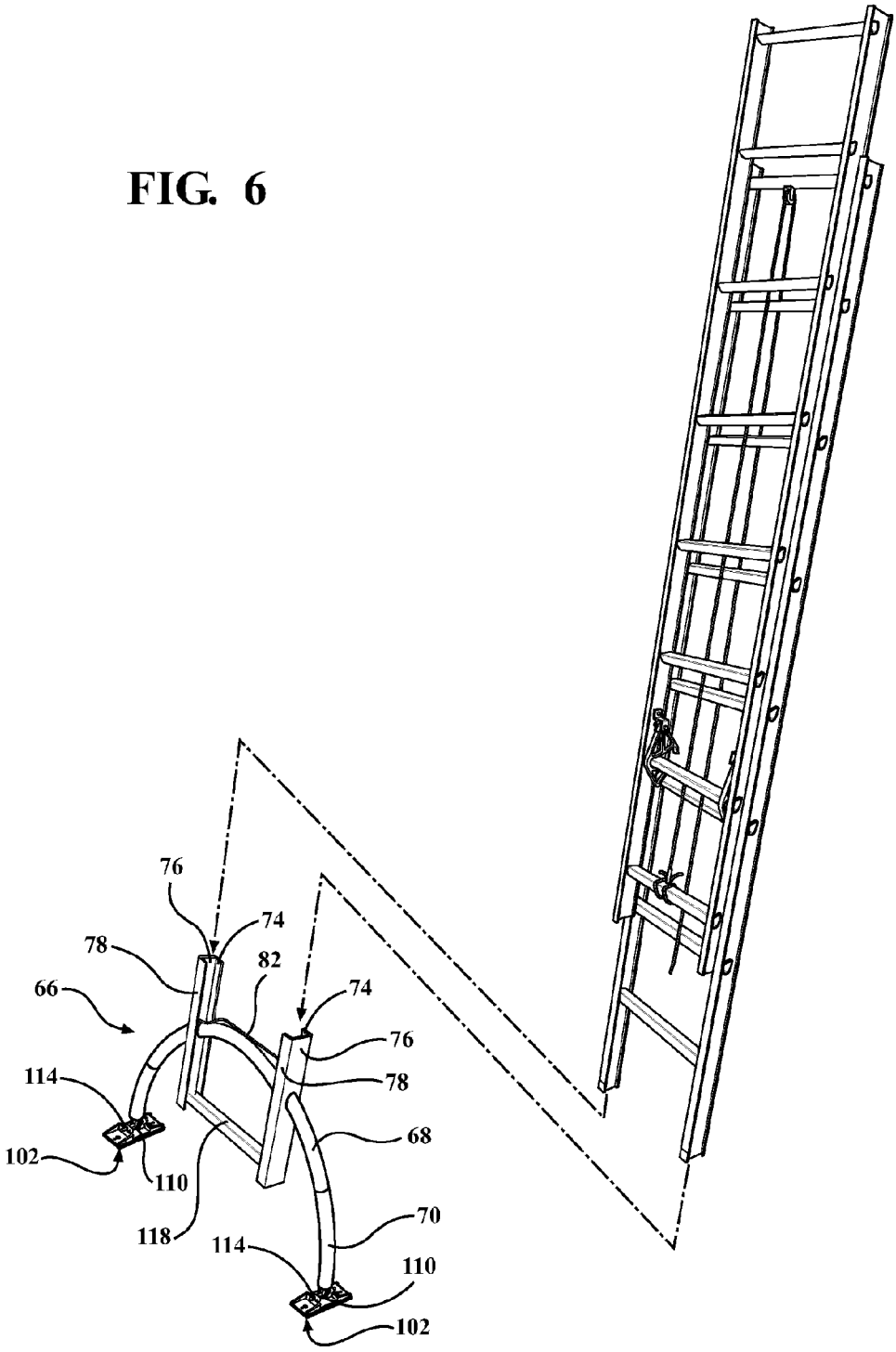
FIG. 6 is a perspective view of a second embodiment of the leveling and stabilizing assembly.

As described above, the preferred embodiment of the invention is integrated with a ladder. However, a second embodiment of the invention or kit 66, is generally shown in FIG. 6. The second embodiment 66 could for example be provided to a ladder manufacturer to attach to their ladders during their manufacturing process. As with the preferred embodiment, the second embodiment 66 includes a first arcuate tube 68 having a first length for attachment to the ladder. A second arcuate tube 70 has a second length that is greater than the first length and is slidably disposed in the first arcuate tube 68. The third embodiment 66 includes a pair of brackets 72, generally indicated, each attached to the first arcuate tube 68 in a spaced relationship for slidably engaging a pair of legs of the ladder. The brackets 72 each have a first portion 74 and a second portion 76 attached to and extending transversely from the first portion 74. The brackets also include a third portion 78 extending transversely from the second portion 76 and generally parallel to the first portion 74. The brackets may be attached to the legs of the ladder using any fastening method, such as, but not limited to riveting, bolting, screwing, gluing, or welding. It should be understood that the brackets 72 may also be shaped or formed in alternative configurations. Their shape primarily depends on the shape and dimensions of the ladder to which they will be attached.

As with the preferred embodiment, a lock subassembly 80 (FIG. 3) is disposed on the first arcuate tube 68 for engaging the second arcuate tube 70 and limiting movement of the second arcuate tube 70 relative to the first arcuate tube 68. A step lever 82 extends along the first arcuate tube 68 and is coupled with the lock subassembly 80. The first arcuate tube 68 of the second embodiment 66 includes a first flange 84 and a second flange 86 each extending radially from the first arcuate tube 68 in a spaced relationship and generally parallel to each other. The first flange 84 and the second flange 86 each define a passage.

The lock subassembly 80 of the second embodiment 66 includes an actuating member 88 (FIG. 3) having a proximate end and a distal end and is movable between a clamped position and an unclamped position. The step lever 82 of the second embodiment 66 is attached to the actuating member 88 to move the actuating member 88 to the clamped position. The actuating member 88 defines a cam surface 90 disposed at the proximate end and a cavity 92 disposed at the distal end. The cam surface 90 of the actuating member 88 abuts the second flange 86. The actuating member 88 also includes a dowel 94 extending through the actuating member 88 adjacent the distal end. The lock subassembly 80 includes a bar 96 having a threaded portion that extends through the passage of the first flange 84 and through the passage of the second flange 86 into the cavity 92 of the actuating member 88. The dowel 94 of the actuating member 88 attaches to the bar 96 for allowing the actuating member 88 to rotate between the lock position and the unlock position. A nut (not shown) threadedly engages the threaded portion of the bar 96 and abuts the first flange 84. The first arcuate tube 68 defines a channel 100 between the first flange 84 and the second flange 86 and adjacent to the actuating member 88. Movement of the step lever 82 to the locked position causes the cam surface 90 to move the second flange 86 toward the first flange 84 to slightly deform the first arcuate tube 68 about the second arcuate tube 70. It should be understood that other lock subassemblies 80 may include alternative mechanisms such as, but not limited to a slide clamp, a rotary clamp, or a frictional interference lock. In general, the operation of the lock subassembly 80 of the second embodiment 66 is identical to the operation of the lock subassembly 26 of the preferred embodiment.

The second embodiment 66 also includes a foot 102, generally indicated, pivotably disposed at each end of the second arcuate tube 70 as shown in FIG. 6 to allow the ladder to be placed on sloped, uneven, or rough surfaces. Referring back to FIGS. 4A, 4C, and 4D, the foot 102 includes a plate 104 and a pair of protrusions 106 extending from the plate 104. A cleated bottom 107 (FIG. 4B) is attached to the plate 104 for gripping a surface on which the ladder is placed. Each protrusion 106 defines an opening 108. The foot 102 also includes a connector 110 (FIGS. 5A and 5B) that defines an aperture 112 and is attached to the second arcuate tube 70. The connector 110 is disposed between the protrusions 106 of the foot 102. A bolt 114 extends through the openings 108 and between the protrusions 106 and through the aperture 112 of the connector 110 to pivotably attach the foot 102 to the second arcuate tube 70 and enable the foot 102 to pivot freely in three dimensions. As best shown in FIG. 5B, the connector 110 includes a projection 116 extending into the aperture 112 to allow a broad range of motion of the connector 110 relative to the bolt 114 as the foot 102 pivots.

The second embodiment 66 also includes a lower step member 118 which takes the form of a rung that is disposed below the tubes 68, 70. This allows the second embodiment to meet the various industry and workplace safety requirements described above. It should be understood that other embodiments may utilize different structures for the lower step member 118.

Figure 7:
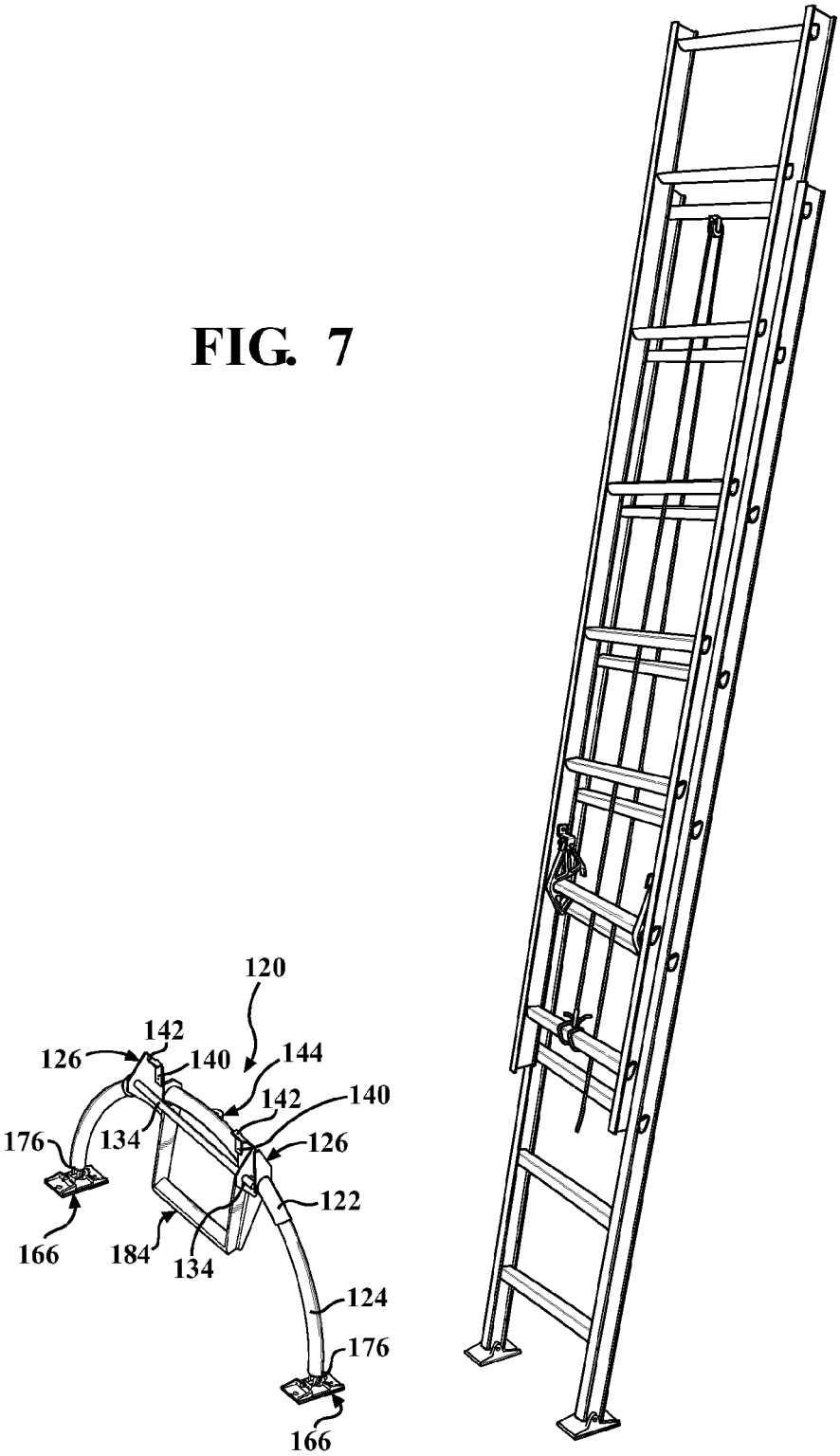
FIG. 7 is a perspective view of a third embodiment of the leveling and stabilizing assembly.

A third embodiment of the invention or kit 120, is generally shown in FIG. 7, may be easily attached and removed from a ladder. As with the preferred and second embodiments, the third embodiment 120 includes a first arcuate tube 122 having a first length for attachment to the ladder. A second arcuate tube 124 has a second length that is greater than the first length and is slidably disposed in the first arcuate tube 122. The third embodiment 120 includes a pair of brackets 126, generally indicated, each attached to the first arcuate tube 122 in a spaced relationship for slidably engaging a pair of legs of the ladder. The brackets 126 each define a bore 128 (FIG. 9) for aligning with a rung of the ladder. The brackets 126 each have a first portion 130 and a second portion 132 attached to and extending transversely from the first portion 130. The second portion 132 of each bracket 126 defines the bore 128. It should be understood that the brackets may also be shaped or formed in alternative configurations.

Figure 8:
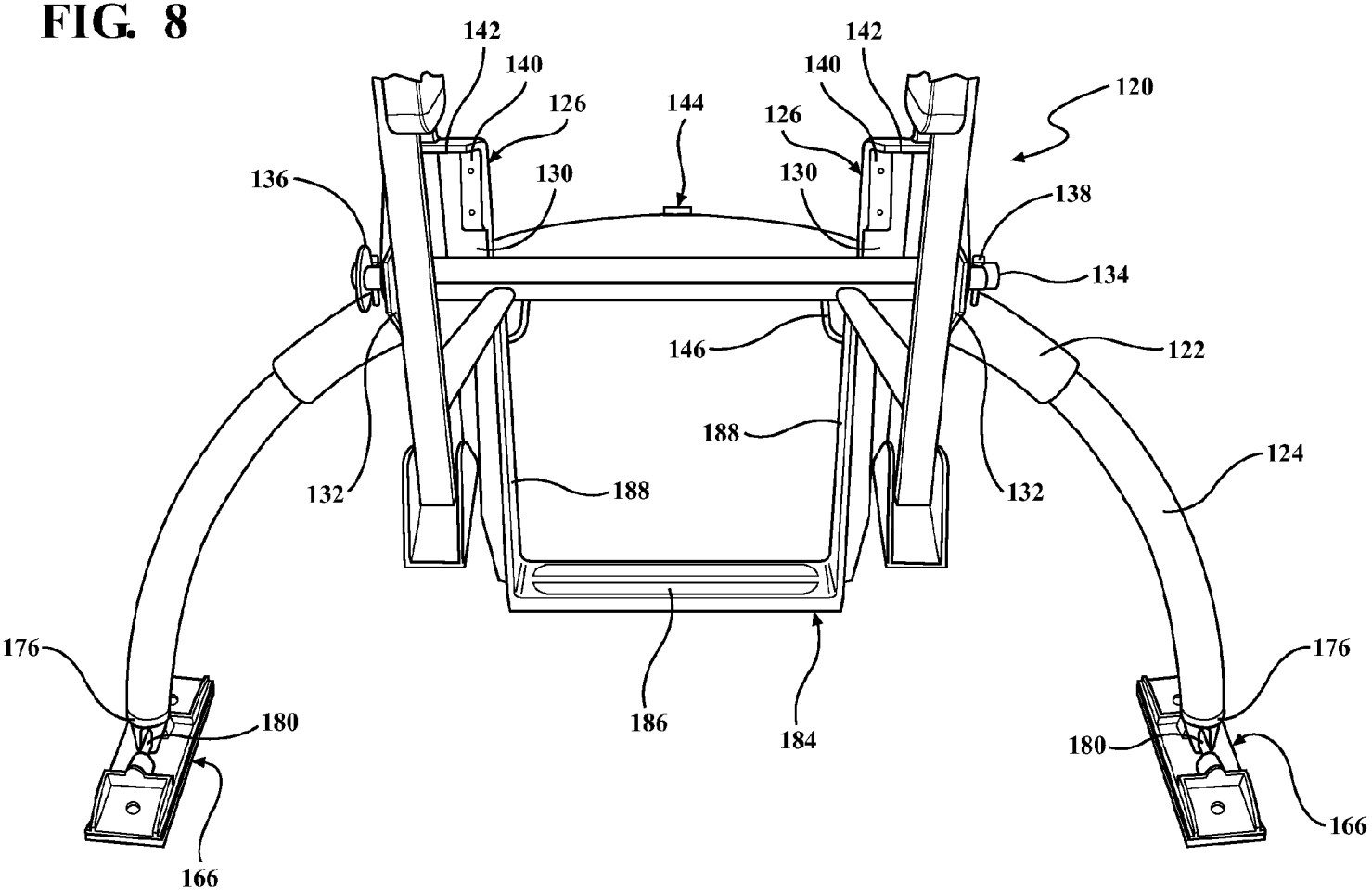
FIG. 8 is a perspective view of the third embodiment of the leveling and stabilizing assembly illustrating attachment to a ladder.

As best shown in FIG. 8, the third embodiment 120 also includes a rod 134 for temporarily attaching the third embodiment 120 to the ladder. The rod 134 extends through a rung of the ladder and through the bore 128 of each of the brackets 126 when assembled. At one end of the rod 134, a washer 136 attaches to one end of the rod 134 to secure of the rod 134 relative to the rung. Additionally, a pin 138 is used on the opposite end of the rod 134 to retain the rod 134 in the rung. Therefore, the third embodiment 120 may be attached to the ladder without requiring the use of tools. It should be appreciated that the third embodiment 120 could instead include other structures or mechanisms such as, but not limited to a plate or arm that attaches to the brackets 126 and rotatably engages a rung of the ladder to secure the third embodiment 120 to the ladder.

The third embodiment 120 also includes a pair of braces 140 (FIGS. 8 and 9) each attached to one of the brackets 126 to secure the bracket 126 to an inner part of the leg of the ladder. The braces 140 each include a slide portion 142 extending transversely from the brace 140 toward the second portion 132 of the bracket 126. The braces 140 are in a spaced relationship with the first portion 130 of the bracket 126 to allow the inner part of the leg of the ladder be sandwiched between the slide portion 142 and the first portion 130 of the bracket 126. This enables the brackets 126 and tubes 122, 124 of the third embodiment 120 to easily slide on and engage the legs of the ladder.

Figure 10:
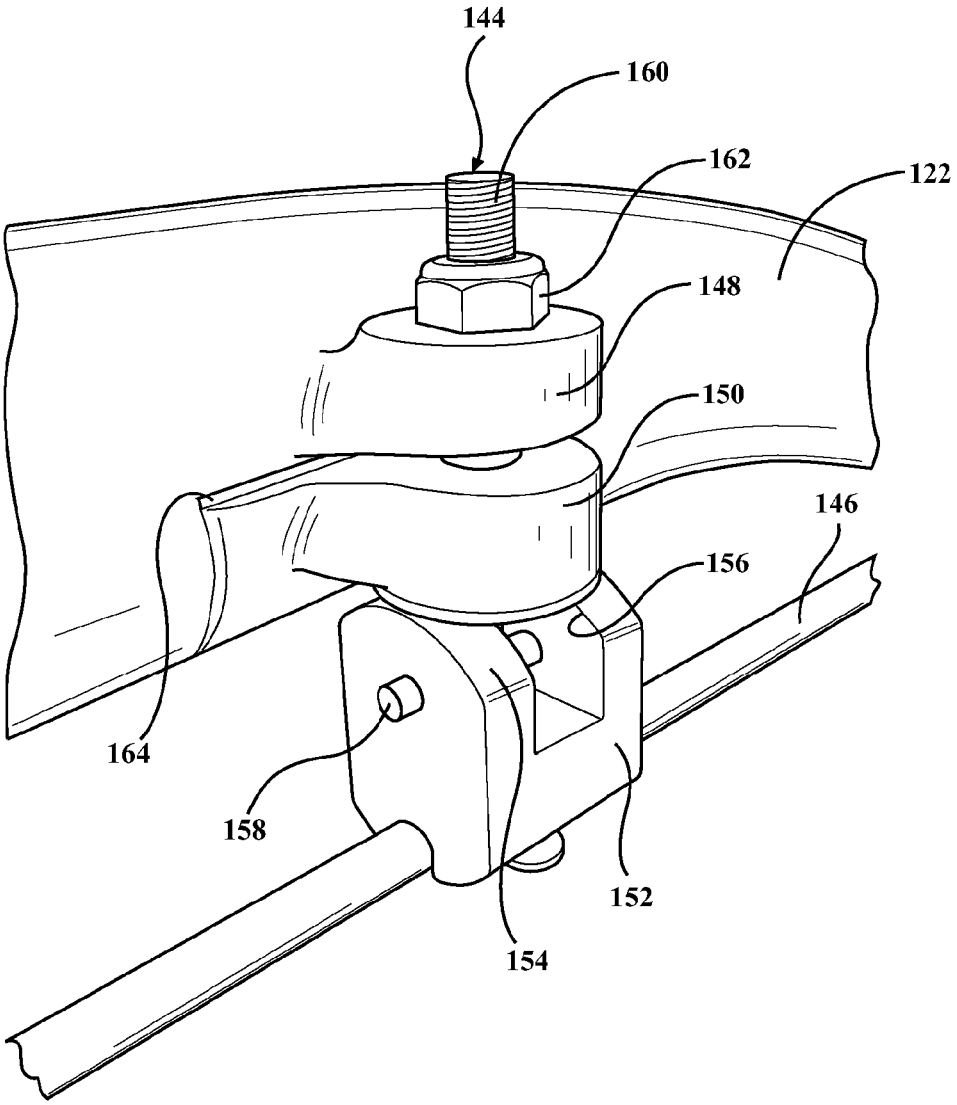
FIG. 10 is a perspective view of the third embodiment of the leveling and stabilizing assembly shown in FIGS. 6-9 illustrating the lock subassembly.

As with the preferred embodiment, a lock subassembly 144, generally indicated in FIG. 10, disposed on the first arcuate tube 122 for engaging the second arcuate tube 124 and limiting movement of the second arcuate tube 124 relative to the first arcuate tube 122. A step lever 146 extends along the first arcuate tube 122 and is coupled with the lock subassembly 144. Instead of extending along and above the first arcuate tube 122 as in the preferred embodiment, the step lever 146 of the third embodiment 120 extends along and below the first arcuate tube 122. Though, like the preferred embodiment, the first arcuate tube 122 of the third embodiment 120 includes a first flange 148 and a second flange 150 each extending radially from the first arcuate tube 122 in a spaced relationship and generally parallel to each other. The first flange 148 and the second flange 150 each define a passage.

The lock subassembly 144 of the third embodiment 120 includes an actuating member 152 (FIG. 10) having a proximate end and a distal end and is movable between a clamped position and an unclamped position. The step lever 146 of the third embodiment 120 is attached to the actuating member 152 to move the actuating member 152 to the clamped position. The actuating member 152 defines a cam surface 154 disposed at the proximate end and a cavity 156 disposed at the distal end. The cam surface 154 of the actuating member 156 abuts the second flange 150. The actuating member 152 also includes a dowel 160 extending through the actuating member 152 adjacent the distal end. The lock subassembly 144 includes a bar 160 having a threaded portion that extends through the passage of the first flange 148 and through the passage of the second flange 150 into the cavity 156 of the actuating member 152. The dowel 158 of the actuating member 152 attaches to the bar 160 for allowing the actuating member 152 to rotate between the lock position and the unlock position. A nut 162 threadedly engages the threaded portion of the bar 160 and abuts the first flange 148. The first arcuate tube 122 defines a channel 164 between the first flange 148 and the second flange 150 and adjacent to the actuating member 152. Movement of the step lever 146 to the locked position causes the cam surface 154 to move the second flange 150 toward the first flange 148 to slightly deform the first arcuate tube 122 about the second arcuate tube 124. As with the preferred embodiment, it should be understood that other lock subassemblies 144 may include alternative mechanisms such as, but not limited to a slide clamp, a rotary clamp, or a frictional interference lock.

Figure 9:
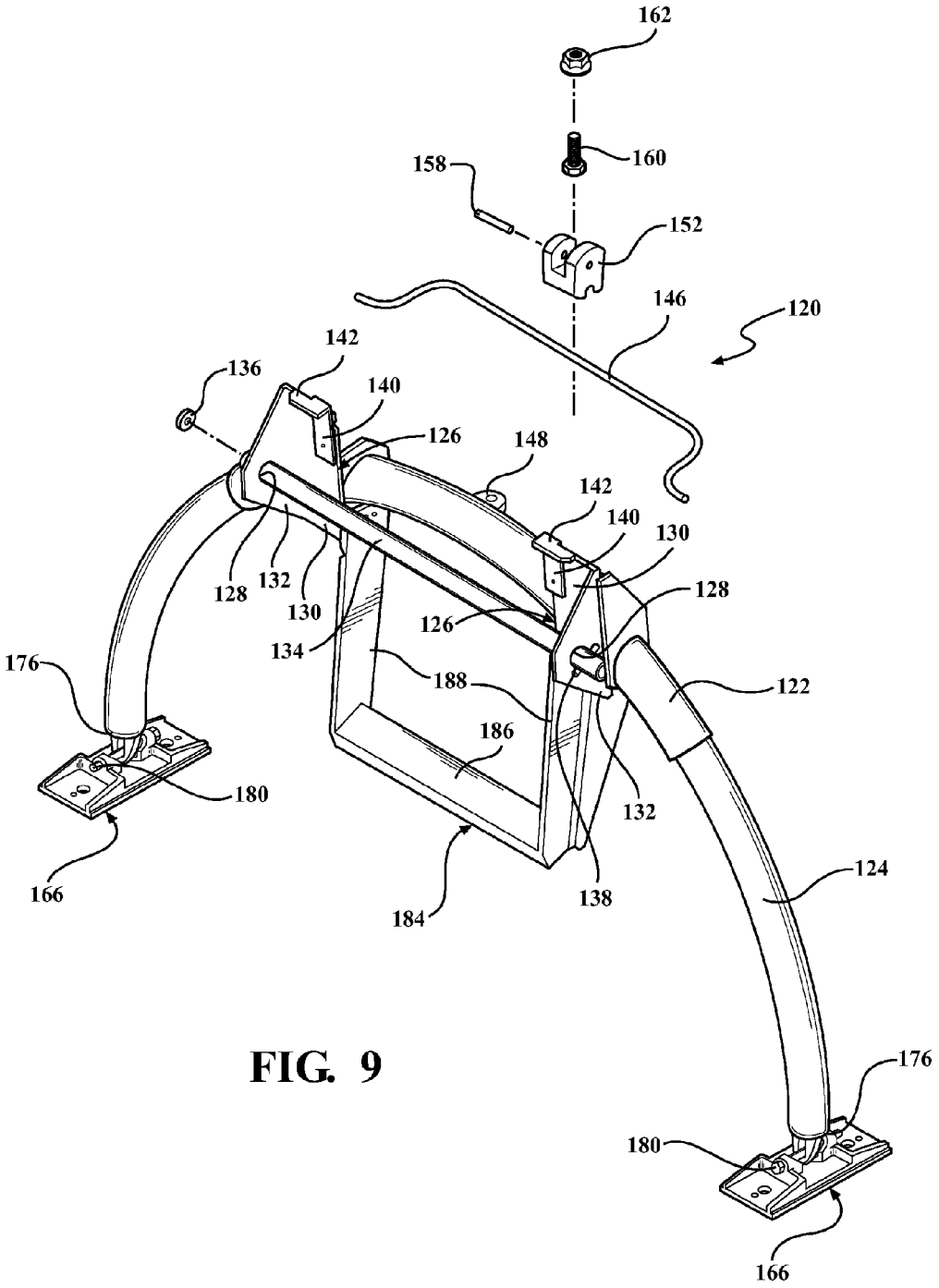
FIG. 9 is an exploded view of the third embodiment of the leveling and stabilizing assembly.

In the same manner as in the preferred embodiment of the invention, the third embodiment 120 also includes a foot 166, generally indicated, pivotably disposed at each end of the second arcuate tube 124 as shown in FIGS. 7-9 to allow the ladder to be placed on sloped, uneven, or rough surfaces. Referring back to FIGS. 4A, 4C, and 4D, the foot 166 includes a plate 168 and a pair of protrusions 170 extending from the plate 168. A cleated bottom 172 (FIG. 4B) is attached to the plate 168 for gripping a surface on which the ladder is placed. Each protrusion 170 defines an opening 174. The foot 166 also includes a connector 176 (FIGS. 5A and 5B) that defines an aperture 178 and is attached to the second arcuate tube 124. The connector 176 is disposed between the protrusions 170 of the foot 166. A bolt 180 extends through the openings 174 and between the protrusions 170 and through the aperture 178 of the connector 176 to pivotably attach the foot 166 to the second arcuate tube 124 and enable the foot 166 to pivot freely in three dimensions. As best shown in FIG. 5B, the connector 176 includes a projection 182 extending into the aperture 178 to allow a broad range of motion of the connector 176 relative to the bolt 180 as the foot 166 pivots.

The third embodiment 120 also includes a lower step member 184 (FIGS. 8 and 9), generally indicated, which has a step 186 extending between a pair of sides 188. The sides 188 each extend transversely from the step 186 to form a general U-shape. The lower step member 184 is pivotably attached to and extends between the brackets 126. The step lever 146 pivotably attaches to the lower step member 184 and is coupled with and extends between the brackets 126. As the user steps onto the step 186 of the lower step member 184, the step lever 146 to moves to the locked position. As in the preferred embodiment of the invention, movement of the step lever 146 to the locked position moves the actuating member 152 to the clamped position and causes the cam surface 154 to move the second flange 150 toward said first flange 148 to slightly deform the first arcuate tube 122 about the second arcuate tube 124 so that the first arcuate tube 122 engages the second arcuate tube 124. This operation is advantageous since the user does not need to remember to activate the lock subassembly 144. Instead, the user simply begins to climb the ladder and by stepping on the step 186 of the lower step member 184, the lock subassembly 144 safely secures the second arcuate tube 124 relative to the first arcuate tube 122. When the user is ready to move the ladder to an new location, he or she can move the lower step member 184 which causes step lever 146 to move to the unlocked position and causes the cam surface 154 to move and allow the second flange 150 to move away from the first flange 148 and remove the deformation of the first arcuate tube 122 about the second arcuate tube 124. This allows the first arcuate tube 122 to disengage the second arcuate tube 124.

Figure 11:
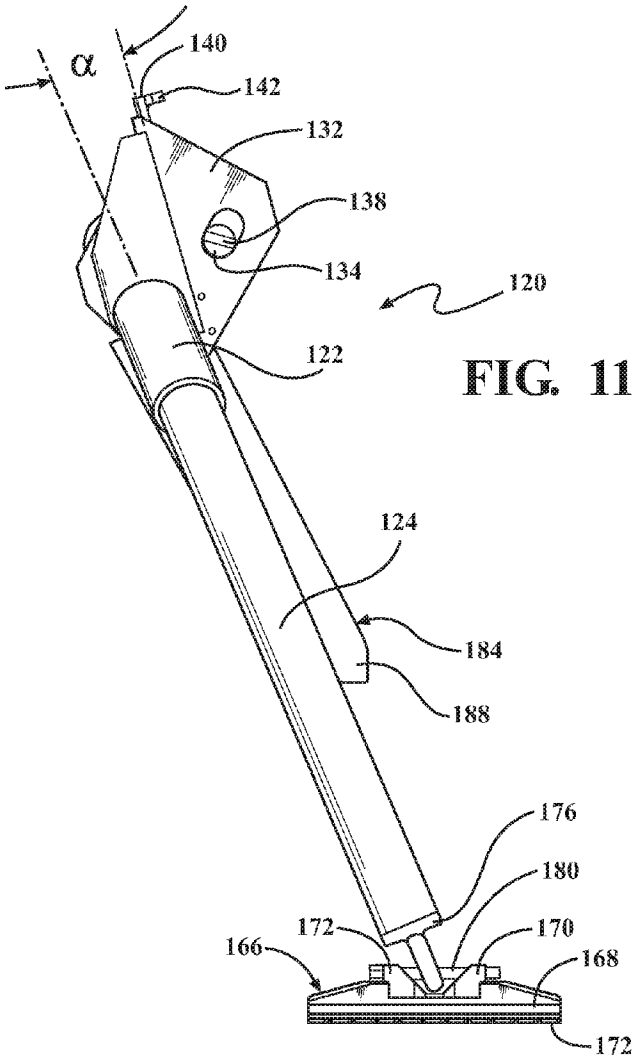
FIG. 11 a perspective view of the third embodiment of the leveling and stabilizing assembly.

As can be seen in FIG. 11, in order to help stabilize the ladder as it is in use, the first arcuate tube 122 and the second arcuate tube 124 of the third embodiment of the invention are canted at a predetermined angle $\alpha$ relative to and away from the ladder. More specifically, the tubes 122, 124 are canted away from a surface or an object that the ladder will be resting against. This canting helps prevent any unintended movement or tilting of the ladder away from the surface or object. The canting of the tubes 122, 124 helps ensure that the intersection of the bolt 180 and the aperture 178 of the connector 176 is aligned with an axis which extends along the legs of the ladder. The predetermined angle $\alpha$ is preferably at least five degrees (5°) and preferably less than twenty-five degrees (25°). Nevertheless, it should be understood that the predetermined angle $\alpha$ may be chosen outside this range in some embodiments.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. An assembly for stabilizing and leveling a ladder comprising:

a first arcuate tube having an apex for attachment to the ladder;

a second arcuate tube slidably disposed in said first arcuate tube;

a lock subassembly disposed on the apex of said first arcuate tube for engaging said second arcuate tube and limiting movement of said second arcuate tube relative to said first arcuate tube;

a lower step member disposed below said apex of said first arcuate tube and coupled with said first arcuate tube; and a step lever extending along said first arcuate tube tangentially to said apex and coupled with said lock subassembly, the step lever configured to move between an unlocked position and a locked which moves said lock subassembly, whereby movement of said step lever to the locked position causes a deformation of said first arcuate tube about said second arcuate tube which causes said first arcuate tube to engage said second arcuate tube which prevents relative movement between said first and second arcuate tubes, and movement of said step lever to the unlocked position removes the deformation of said first arcuate tube about said second arcuate tube and causes disengagement of said first arcuate tube from said second arcuate tube.

2. An assembly as set forth in claim 1 wherein said lock subassembly includes an actuating member defining a cam surface and movable between a clamped position and an unclamped position and coupled with said first arcuate tube and with said step lever to deform said first arcuate tube about said second arcuate tube and engage said second arcuate tube in response to movement of said step lever to the locked position.

3. An assembly as set forth in claim 2 wherein said first arcuate tube defines a channel adjacent said actuating member.

4. An assembly as set forth in claim 3 wherein said first arcuate tube includes a first flange and a second flange each extending radially from said first arcuate tube in a spaced relationship and generally parallel to each other and said first flange and said second flange each defining a passage;

said cam surface of said actuating member abutting said second flange;

said lock subassembly including a bar extending through said passage of said first flange and through said passage of said second flange and coupled with said actuating member; and said step lever attached to said actuating member to move said actuating member to the clamped position and cause said cam surface to move said second flange toward said first flange to deform said first arcuate tube about said second arcuate tube and engage said second arcuate tube in response to movement of said step lever to the locked position and to move said actuating member to the unclamped position and cause said cam surface to allow said second flange to move away from said first flange and remove said deformation of said first arcuate tube about said second arcuate tube and disengaging said first arcuate tube from said second arcuate tube in response to movement of said step lever to the unlocked position.

5. An assembly as set forth in claim 1 further including a foot pivotably disposed at each end of said second arcuate tube to allow the ladder to be placed on sloped and uneven surfaces.

6. An assembly as set forth in claim 5 wherein said foot includes a plate and a pair of protrusions extending from said plate and each defining an opening and said foot including a connector defining an aperture and attached to said second arcuate tube and disposed between said protrusions and said assembly further includes a bolt extending through said openings and between said protrusions and through said aperture of said connector to pivotably attach said foot to said second arcuate tube and enable said foot to pivot freely in three dimensions.

7. An assembly as set forth in claim 6 wherein said foot further includes a cleated bottom attached to said plate gripping a surface on which the ladder is placed.

8. An assembly as set forth in claim 6 wherein said connector further includes a projection having a pointed triangle shaped cross-section extending from said connector into said aperture to allow a range of motion of said connector relative to said bolt as said foot pivots.

9. An assembly as set forth in claim 1 wherein said step lever extends along said first arcuate tube above said apex of said first arcuate tube.

* * * * *